United States Patent [19]

Neary

[11] 4,068,510

[45] Jan. 17, 1978

[54] DOUBLE CYLINDER SAFETY LOCK

[75] Inventor: Ralph E. Neary, San Francisco, Calif.

[73] Assignee: Schlage Lock Company, San Francisco, Calif.

[21] Appl. No.: 695,304

[22] Filed: June 28, 1976

[51] Int. Cl.[2] ..... E05B 9/10

[52] U.S. Cl. ..... 70/379 R; 70/DIG. 42; 70/DIG. 60

[58] Field of Search ..... 70/379 R, 379 A, 380, 70/DIG. 60, DIG. 42

[56] References Cited

U.S. PATENT DOCUMENTS

| | | | |
|---|---|---|---|
| 1,564,463 | 12/1925 | Best | 70/379 R |
| 1,850,586 | 3/1932 | Heyer | 70/380 |
| 2,042,025 | 5/1936 | Schlage | 70/379 R |
| 2,691,290 | 10/1954 | Schlage | 70/379 R |

*Primary Examiner*—Robert L. Wolfe
*Attorney, Agent, or Firm*—Lothrop & West

[57] ABSTRACT

A double cylinder safety lock has a bolt projected and retracted by a device having a rotatable hub. A key operated exterior device has a lost-motion connection to the rotatable hub so the key can be extracted from the device with the bolt in projected position or retracted position. A key operated interior device has either a direct or a lost-motion connection (depending upon the key used) to the rotatable hub, the hub connections being arranged to turn together. A key for the interior device can project and retract the bolt but can be extracted only when the bolt is in retracted position.

9 Claims, 9 Drawing Figures

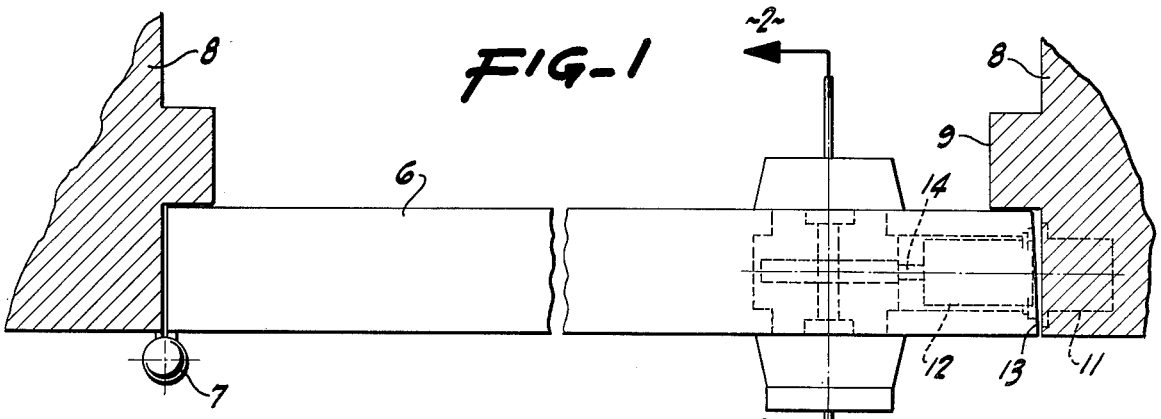
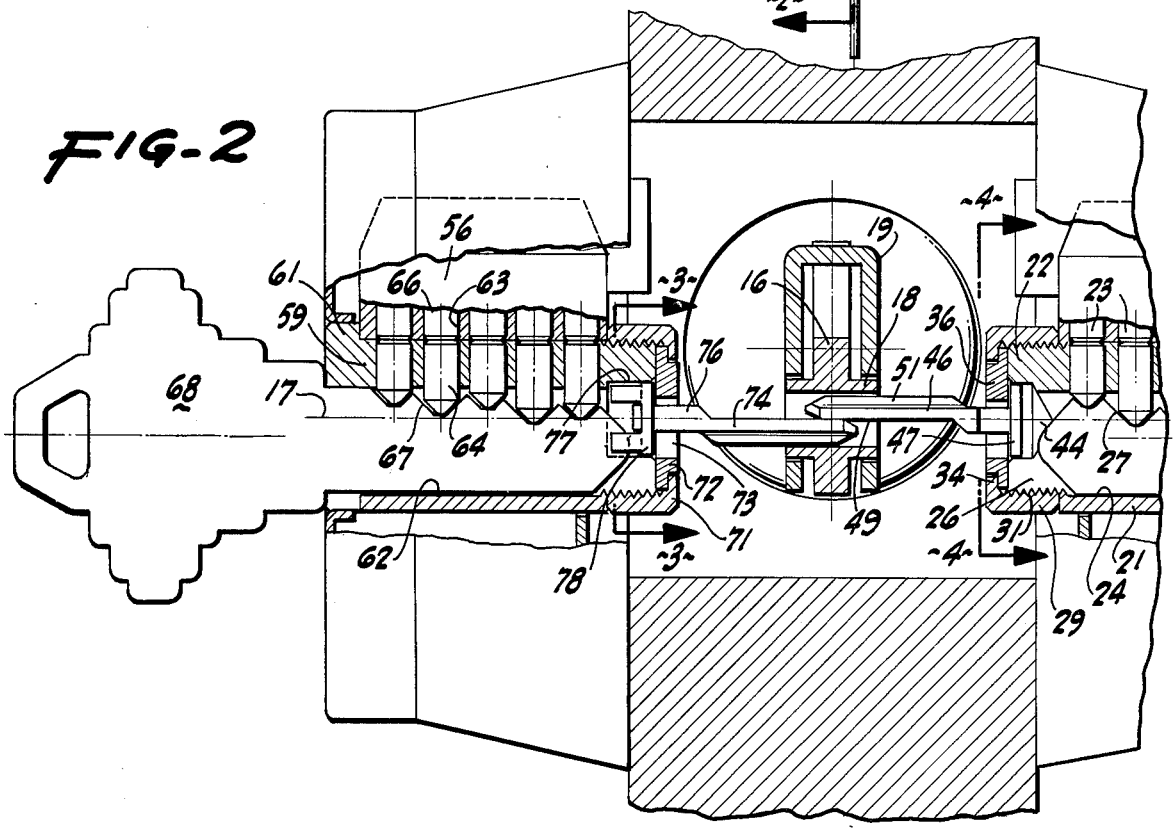
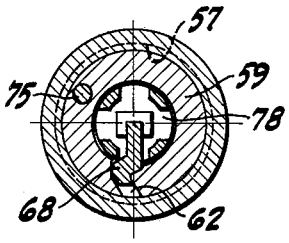
FIG-3
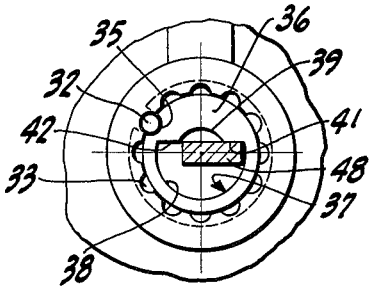
FIG-4

DOUBLE CYLINDER SAFETY LOCK

There are increasing requirements for security with regard to door panel access to an enclosure such as a room. It is increasingly prevalent to provide on the door panel a bolt for interengaging the panel with a door frame. The bolt is actuated by a key from the exterior side and is likewise provided with another key actuator from the interior side. This arrangement adds to the security but may be dangerous under extreme conditions such as fire or panic. For example, a person might lock himself into his room by using his key to throw the bolt into projected position to lock the door panel to the door frame. If he then removes the key and subsequently is in a panic condition, he may not be able readily to withdraw the bolt to open the door and escape the calamity. It is, therefore, advantageous under many circumstances to provide an arrangement in which the key that actuates the bolt from the interior is retained or held in the interior bolt mechanism so that it cannot be removed when the bolt is projected, thereby always ensuring that a bolt retracting key is available to a person within the room. A somewhat comparable mechanism for the indicated purpose is disclosed in the co-pending application of Ernest L. Schlage Ser. No. 676,213 filed Apr. 12, 1976 entitled Key Retaining Cylinder For A Lock and assigned to the assignee of the present application. That application discloses a special arrangement of the lock mechanism to retain the interior key.

It is considered advisable and desirable to have a key retaining feature that does not require special lock mechanism but that can be arranged with very little alteration in standard locking elements.

It is therefore an object of the invention to provide a lock mechanism in which a key is retained when the bolt is projected or in locked condition.

Another object of the invention is to provide a key retaining feature by a small alteration in the standard lock mechanism.

Another object of the invention is to provide such an arrangement which is especially effective in connection with a double cylinder safety lock; this is, one in which there is an exterior lock mechanism and an interior lock mechanism.

A further object of the invention is to provide a lock arrangement in which the safety mechanism can readily be incorporated in structures already utilized.

Another object of the invention is to provide an improved safety lock mechanism.

A further object of the invention is in general to provide an improved key retaining lock.

Other objects, together with the foregoing, are attained in the embodiments of the invention described in the accompanying description and illustrated in the accompanying drawings, in which:

FIG. 1 is a cross-section on a horizontal median plane through a door frame and panel including a safety lock mechanism;

FIG. 2 is a sectional view to an enlarged scale, the plane of section being indicated by the line 2—2 of FIG. 1 and portions being broken away to reduce the size of the figure;

FIG. 3 is a cross-section, the plane of which is indicated by the line 3—3 of FIG. 2;

FIG. 4 is a cross-section, the plane of which is indicated by the line 4—4 of FIG. 2;

Figure 5:
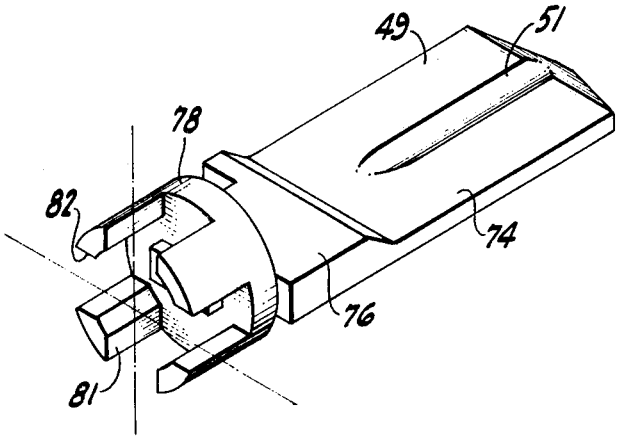
FIG. 5 is an isometric view of an interior actuator to an enlarged scale.
Figure 7:
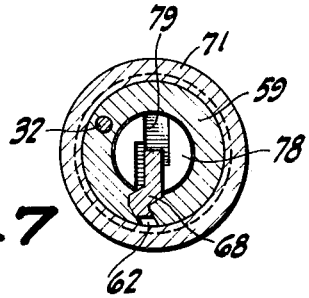
FIG. 7 is a cross-section, approximately on the lines 3—3 of FIG. 2, but showing the use of the structure of FIG. 6.

In an exemplary installation there is provided a door panel 6 adapted to swing about the vertical axis of a hinge 7 with respect to a door frame 8. The door panel in its closed position, as shown in FIG. 1, is adapted to rest against a door stop 9 forming part of the frame 8. In the frame there is a bolt box 11 designed to receive a bolt 12 when projected. The bolt when retracted does not project beyond the edge 13 of the door panel 6 but when projected does extend beyond such edge and occupies much or all of the box 11 so that the door is locked in closed position. The bolt 12 is provided with a standard form of actuator, as shown in Walter R. Schlage U.S. Pat. No. 2,042,121 of May 26, 1936, to which reference is made for the details of construction.

In general, the bolt 12 is connected by a suitable link 14 to one end of a lever 16 (FIG. 2) that is rotatable about an axis 17 extending usually horizontally and normal to the general plane of the door panel 6. The lever 16 is inclusive of an extended hub 18 journalled in a bolt frame 19 fixed within the door panel 6. When the bolt lever 16 is in one extreme position the bolt 12 is retracted, whereas when the bolt lever is in its other extreme position (usually about 90° of rotation away) the bolt is then projected. Customarily an overcenter spring mechanism is utilized to urge the bolt into either of its extreme positions.

On one side of the panel 6, referred to as the "exterior" side, although the designation is arbitrary, there is provided a means for operating the bolt 12 between projected and retracted positions. This is a standard structure and includes a pin tumbler cylinder mechanism. Such mechanism includes a cylinder housing or body 21 in which a cylinder plug 22 is rotatable about the axis 17. The plug and the body are appropriately provided with bores transverse of the axis 17 to receive one or more tumbler pin mechanisms 23. Each of the pin mechanisms has at least two positions. In one position each of the pins, as shown in FIG. 2, lies entirely in the body or plug, whereas in another position one or another of the pins lies within both the body and plug to preclude relative rotation thereof. The pins are customarily provided with springs urging them into a locked condition. The pins are, however, disposed in an unlocked condition by the presence of an exterior key 24 occupying a keyway 26 within the plug 22 and extending along the axis 17. The key was a plurality of notches 27 therein interfitting with the pins 23.

The arrangement is such that while the key can be introduced into the keyway and withdrawn from the keyway with relative ease, nevertheless the pins 23 partially interlock therewith. In fact, when the key and pins are in the position shown in FIG. 2, the key can readily be withdrawn, the pins easily following the undulatory configuration of the key edge by moving into and out of different portions of the pin bores. But when the plug is in a different rotated position with respect to the body, then the pins 23 cannot move in their bores since one end is interengaged with a key notch and the other end lies against the bore wall in the body. Under those circumstances the key cannot be withdrawn.

In accordance with a construction as shown in Ernest L. Schlage U.S. Pat. No. 691,290 of Oct. 12, 1954, to which reference is made for details of construction, the plug is particularly interrelated with the body. At the exterior, key end (not shown in FIG. 2) the plug 22 has an enlarged flange which abuts against the outer end of the body 21. At the inner end there is provided a collar 29 having a threaded engagement 31 with the end of the plug and in abutment with the body. The collar is held in any one of a number of rotated, adjusted positions by an axially extending pin 32 (FIG. 4) movable in the plug and spring pressed axially or endwise thereof to seat within one of a number of peripheral, internal serrations 33 in the inturned flange 34 of the collar. The pin 32 also extends through a notch 35 in a drive plate 36 resting against the end of the plug 22.

The drive plate 36, as shown particularly in FIG. 4, has a noncircular opening 37 therein made up of a pair of arcuate portions 38 and 39 separated by approximately radial or chordal shoulders 41 and 42. By this mechanism the end play of the plug in the body is readily adjusted by screwing the collar 29 into an appropriate approximate location and holding the collar in selected position by interengagement of the spring pressed pin 32 with one of the serrations 33 or scallops in the flange thereof. The drive plate notch 35 receives the pin 32, so that the drive plate always has the same rotary orientation as does the plug. That is, rotation of the plug 22 and of the drive plate 36 are always in synchronism and in the same angular relationship.

The plug 22, in addition to the keyway 26, is also provided with an end cavity 44, generally a circular-cylindrically bounded volume concentric with the axis 17. Adapted to be disposed in the cavity is an end portion of an exterior actuator 46. A disc head 47 forming part of the actuator is retained in the cavity 44. A cutaway shank 48 also part of the actuator extends through and is operable in the noncircular opening 37. Approximately 180° of lost motion are so provided. When the flat shank 48 engages either of the walls 41 and 42, a further rotation of approximately 90° may readily be made. The exterior actuator shank 48 is noncircular and extends into the interior of the hub 18. The configuration of the actuator shank is approximately as shown in FIGS. 5, 6, 8 and 9 and includes a rectangular flat portion 49 with a central rib 51 extending axially. The shank is designed to occupy substantially half of the similarly contoured, noncircular opening in the hub 18.

Assuming that the exterior actuator mechanism is in the position illustrated in FIG. 2, for example, the user, by inserting an appropriate key in the keyway and positioning the appropriate ones of the pins 23, conditions the mechanism so that upon rotation of the key in the keyway the plug 22 is revolved about the axis 17 within the cylinder body 21. For approximately 90° of clockwise rotation the actuator 46 is rotated by engagement of the shoulder 41 with the flat driver bar 48. The bolt is thereby moved from its retracted position to its projected position. If desired, the plug 22 may then be rotated 90° back to its original position without disturbing the actuator 46 and the key may then be extracted, leaving the bolt in its projected position. To retract the bolt, the key is again inserted in the keyway and the plug is rotated counterclockwise. For approximately 90° of such rotation there is lost motion and the actuator is not disturbed, but after such amount of rotation there is engagement of the shoulder 42 with the flat driver bar 48. A further 90° of rotation of the key in a counterclockwise direction produces a corresponding 90° of rotation of the shank 48 and of the hub 18, sufficient rotation to retract the bolt 12. The plug 22 may then be rotated 180° clockwise back to its original position without disturbing the actuator 46 and the key may then be extracted, leaving the bolt retracted. This exterior operation is substantially standard for a door of one hand. For a door of the opposite hand, an arrangement having mirror symmetry is used with the turning directions reversed.

On the interior of the door panel 6 there is provided another mechanism in many respects quite similar to but in other respects different from that just described. For example, there is provided on the interior side of the panel 6 a cylinder body 56 having a bore 57 therein concentric with the axis 17 and stationarily mounted on the panel 6. Adapted to rotate in the bore is a cylinder plug 59 having a flange 61 at one end abutting the cylinder body and having an axially extending keyway 62 therethrough. In transverse bores 63 in the cylinder body and cylinder plug there are located pins 64 and 66 urged by springs (not shown) toward the keyway. The pins 64 interengage with notches 67 in a key 68 receivable in the keyway. When the key is in position the pins are so arranged that the plug is rotatable in the body, but otherwise, when the key is withdrawn, the pins span the junction between the plug and the body and prevent or block rotation of the plug in the body.

The inner end of the plug is provided with a flanged cap 71, similar to the cap or collar 29, threaded in place on the inner end of the plug 59 and abutting the body. This affords an end restraint cooperating with the flange 61 to maintain the plug in proper axial position with respect to the body. The cap 71 has a number of serrations in it comparable to the serrations 33 and is similarly locked in place by a comparable pin 75. That pin 75 also engages a notch in a driver plate 72, comparable to the plate 36, disposed at the end of the plug and retained by the flange of the cap 71. The driver plate 72 is so held in proper oriented position with regard to the plug. That is, the plug and the driver plate always operate in unison. The driver plate has a noncircular opening 73 therein like the opening 37.

Adapted to pass through the driver plate is an actuator or driver bar 74 similar to the actuator or driver bar 46. At one end the bar 74 has a noncircular cross-sectional configuration entering into the noncircular hub 18 and overlapping and in rotary effect continuing the actuator 46. The cross-sectional configuration of the driver bars is complementary and substantially fills the noncircular opening in the hub. The driver bars can move axially with respect to each other to overlap variably and take car of different thicknesses of door panels. With this arrangement the two actuators or driver bars 46 and 74 always rotate together and with the hub 18.

The driver bar 74 has a flat shank portion 76 comparable to the portion 48 and of a similar cross-section so that there is afforded about 180° of lost motion between the driver bar shank and the driver plate 72, but after the lost motion is used up there is available at least another 90° of conjoint rotation of the driver disc and the driver bar.

The plug 59 is quite comparable to the plug 22 except that there is an end cavity 77 in the plug 59 that is approximately the same diameter as the cavity 44 and so is standard but is axially deeper than the cavity 44. The cavity 77 opens into and merges with the keyway 62 and is likewise open at the inner end of the plug.

Figure 6:
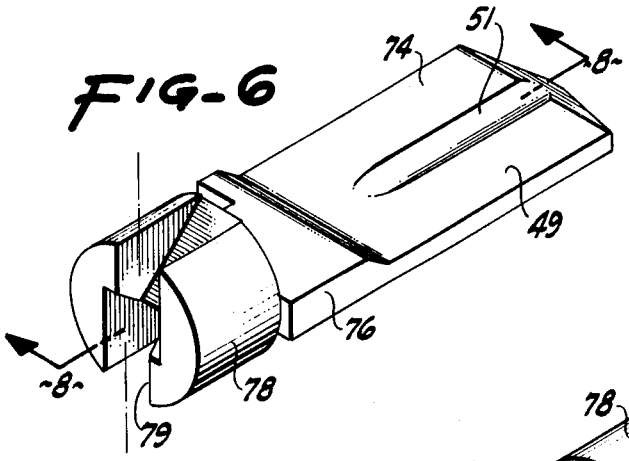
FIG. 6 is a view, like FIG. 5, but showing an alternate form of actuator.
Figure 9:
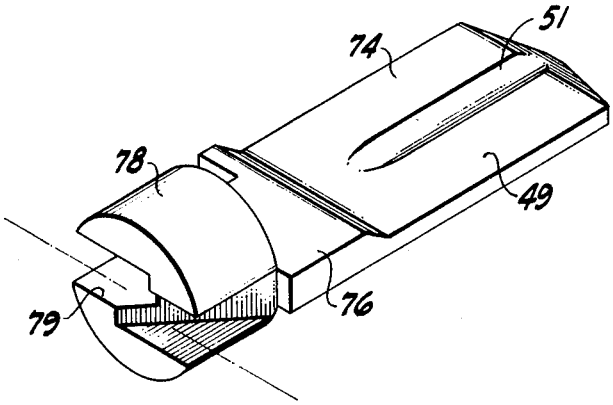
FIG. 9 is a view comparable to FIG. 6 but showing a variation of the actuator of FIG. 6.

Within the cavity 77 there is disposed a boss 78 united nonrotatably with the end of the driver bar shank 76. The boss occupies substantially all of the axial space in the cavity and is provided (FIG. 6) with at least one cross slot 79 offset between its ends. The slot 79 is disposed in the boss in position snugly to receive the tip of the key 68. In one instance the slot 79, as shown in FIG. 6, has its general direction at right angles to the plane of the actuator shank 76. In another instance, as shown in FIG. 9, the cross slot 79 is substantially coplanar with the shank 76. In another arrangement, as shown in FIG. 5, the boss 78 is provided with cross slots 81 and 82, one of which is arranged at right angles to the general plane of the shank 76, as in FIG. 6, and the other of which is arranged substantially in the plane of the shank 76, as shown in FIG. 9. An important factor is that the axial dimension of the boss 78 is great enough so that a normal; i.e. long, key 68 in position and in engagement with all of the pins in the plug also lies in and is embraced by a slot in the boss.

In operation, a key in the keyway and in engagement with the boss upon rotation not only rotates the plug within the body in the usual way but likewise rotates the boss and the attached actuator 74 and so directly, without lost motion, operates the lever and bolt mechanism. This rotary motion is not inclusive of any lost motion.

Figure 8:
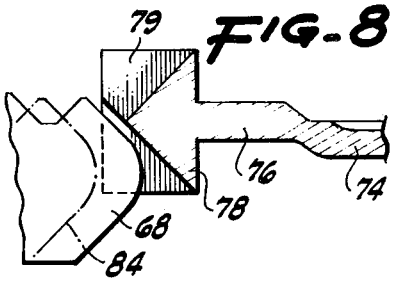
FIG. 8 is a cross-section approximately on the plane indicated by the lines 8—8 of FIG. 6, showing the actuator of FIG. 6 in relationship to different keys.

It is possible, however, as shown in FIG. 8, to employ a key 84 that is shorter than the standard, long key 68. When such a key is in the keyway, the key does not interengage with whatever one of the notches 79, 81 or 82 may be used, although the key interengages with all of the pins 64. Under these circumstances, when the short key 68 is rotated, the plug 59 also rotates and rotates the driver plate 72, which through the lost motion operates the actuator 74. When a long key is used in direct connection with the boss, there is a connection to the bolt actuator without lost motion. When a short key is used, there is no engagement with the boss and the plug is connected to the key actuator through a lost motion connection.

An interior plug rotation of approximately 90° is effective to project the bolt into locked position. Since the plug moves only through about 90°, the various pins 64 are in engagement with the inside surface of the bore 57 and, being interlocked with the key 68, hold the key against axial extraction. If the key is turned back 90° to a position for withdrawal, the bolt is also retracted. The key cannot be removed when the door is locked.

By utilizing selectively the actuators shown in FIG. 5, FIG. 6 or in FIG. 9, there can be arranged a key rotation and bolt actuation relationship in any of several locations 90° apart from each other. This also affects the relative relationship of the interior lock mechanism and the exterior lock mechanism. In all instances, however, the key retention feature, either when the bolt is projected or when the bolt is retracted, is retained when a standard length key is employed. When a short key is used, the key retention feature is not effective.

As shown in FIG. 2, the correctly notched interior key 68 aligns the tumbler pins with respect to the plug 59 so as to permit rotation of the plug and the actuator 74. The actuator and plug are connected directly, without lost motion, since the tip of the standard key 68 engages the walls of a slot in the boss 78. An exterior key 24 in the keyway 26 when rotated to project or to retract the bolt 12 also concurrently rotates the exterior actuator 46, the interior actuator 74, the plug 59 and the key 68 all as one unit. But if the interior key 68 is improperly cut or is uncut, the tumbler pins are not aligned and the misaligned pins prevent rotation of the plug 59, the key 68 and the actuator 74. Thus, by using an improperly cut or an uncut interior key, the lever 16 and the bolt 12 are held fast and the exterior key, even though proper, is ineffective to project or to retract the bolt, thus providing extra security. Similarly, "picking" of the exterior mechanism does not permit bolt motion.

What is claimed is:

1. A safety lock comprising a bolt, means including a hub rotatable about an axis and having a non-circular hole therein for moving said bolt between a projected position and a retracted position, a plug rotatable about said axis and including means defining a keyway in said plug along said axis, means depending upon the rotary position of said plug for retaining a key in said plug, an actuator at one end disposed in said plug and extending along said axis and occupying only a portion of said hole in said hub, a lost-motion device on said plug for connecting one end of said rotary plug and said one end of said actuator and operable by a key in said keyway in said plug, and a direct device for immediately connecting a key in said keyway in said plug and said end of said actuator.

2. A device as in claim 1 in which said lost-motion device and said direct device are spaced apart along said axis in position to be engaged by different length keys in said keyway.

3. A device as in claim 1 including means defining a cavity on one end of said plug and in which said actuator is a common driver bar extending into said cavity and in which at least one of said connecting devices is in said cavity and has a plurality of end slots in position to be engaged by a key received in said plug.

4. For use in a lock, a plug rotatable about an axis and having therein a keyway extending along said axis and having a coaxial cavity at one end, a driver bar extending along said axis, a rotary lost-motion connection between said one end of said plug and said driver bar, and means on one end of said driver bar disposed in said cavity in axial alignment with said keyway and in position for engagement by the tip of a key in said keyway.

5. A double cylinder safety lock comprising a bolt, means for moving said bolt between a projected position and a retracted position, a rotatable exterior actuator, means including a first rotary lost-motion for connecting said exterior actuator and said means for moving said bolt, a rotatable interior actuator including a plug having a keyway therein and movable between a key releasing position and a key retaining position, means including a second rotary lost-motion for connecting said plug and said bolt moving means, and means directly engaging a key in said plug for directly connecting said bolt moving means to said plug whereby rotation of said exterior actuator operates said bolt moving means and simultaneously rotates said plug.

6. A device as in claim 5 in which said means for connecting said plug and said bolt moving means includes a direct connection to a long key in said plug and a lost-motion connection to a short key in said plug.

7. For use in a lock, a body having a circular-cylindrical bore concentric with an axis, a plug within said bore and rotatable therein about said axis, means defining a keyway in said plug parallel to said axis, means including a pin tumbler mechanism in said body and said plug and interrelated with said keyway, means defining a circular-cylindrical cavity in one end of said plug concentric with said axis, a lost-motion driver plate having a non-circular opening therethrough, means for holding said driver plate rotatably fixed on said end of said plug with said opening around said axis, a non-circular driver bar extending along said axis and passing through said opening with some lost motion and for abutment with said driver plate, a boss fast on said driver bar and disposed in said cavity for rotation about said axis, and means on said boss defining axially extending slots open to a key in said keyway.

8. A device as in claim 7 including a plurality of said slots.

9. A device as in claim 8 in which said slots are polarly spaced from each other.

* * * * *